United States Patent [19]

Harrison

[11] Patent Number: 5,054,858

[45] Date of Patent: Oct. 8, 1991

[54] SELECTIVELY PHASED WATER SUPPLY OF A CUTTER HEAD

[75] Inventor: William Harrison, Stirling, Great Britain

[73] Assignee: Anderson Group PLC, Glasgow, United Kingdom

[21] Appl. No.: 438,474

[22] PCT Filed: Jul. 8, 1988

[86] PCT No.: PCT/GB88/00555

§ 371 Date: Feb. 21, 1990

§ 102(e) Date: Feb. 21, 1990

[87] PCT Pub. No.: WO89/00236

PCT Pub. Date: Jan. 12, 1989

[30] Foreign Application Priority Data

Jul. 8, 1987 [GB] United Kingdom ..... 8716059

[51] Int. Cl.[5] ..... E21C 35/22

[52] U.S. Cl. ..... 299/81; 299/90

[58] Field of Search ..... 299/12, 17, 81, 89, 299/90; 239/101

[56] References Cited

U.S. PATENT DOCUMENTS

| | | | |
|---|---|---|---|
| 4,049,318 | 9/1977 | Fruin | 299/81 |
| 4,368,925 | 1/1983 | Honke | 299/81 X |
| 4,836,613 | 6/1989 | Adam | 299/81 |

FOREIGN PATENT DOCUMENTS

| | | | |
|---|---|---|---|
| 171375 | 2/1986 | European Pat. Off. . | |
| 3144741 | 5/1983 | Fed. Rep. of Germany . | |
| 3441397 | 5/1986 | Fed. Rep. of Germany . | |
| 777213 | 12/1980 | U.S.S.R. | 299/81 |
| 2166469 | 5/1986 | United Kingdom . | |
| 2172316 | 9/1986 | United Kingdom . | |

*Primary Examiner*—Ramon S. Britts
*Assistant Examiner*—David J. Bagnell
*Attorney, Agent, or Firm*—Mason, Fenwick & Lawrence

[57] ABSTRACT

A mining machine having a boom and a rotary cutting head has water jets directed to the picks of the head and apparatus to phase water supply to only those picks engaging the face to be cut. The water supply system includes circumferentially disposed chambers in the cutting head, each to direct at least one jet to one or more picks and each having a valves to control entry of water thereinto. A drive swash plate which is in surface contact with valves in the chambers is adapted in use to be stationary relative to the cutting head for actuating the valves moving into the cutting area. Water is fed to the chambers by a rotatable lance on which the drive swash plate is fixedly mounted. A break swash plate is also mounted on the lance for engagement with a brake adapted to stop rotation of the lance, such that the drive swash plate is in a selected stationary disposition to actuate the appropriate valves moving into the selected cutting area. The brake is selectively controlled by movement of the cutting boom.

9 Claims, 3 Drawing Sheets

SELECTIVELY PHASED WATER SUPPLY OF A CUTTER HEAD

On mining machines engaged in the driving of roadways and faces by cutting and loading out the mineral, it is frequently necessary to utilise water in the operations to reduce airborne dust, by spraying on or close to the cutting means and at the loading or delivery points, and to combat the incidence of incendive sparking.

Although water is used extensively for these purposes, too great a volume in any given time can create problems by increasing the water content in the product, by affecting the floor on which the equipment and personnel are standing and by posing problems in the removal of surface water from the vicinity.

Additionally, it has recently become the practice to direct high velocity water jets at the cutter picks with the object of preventing the build-up of debris in the pick point areas to achieve more efficient cutting and this has met with some success. In this so called 'jet assisted' cutting, the method of achieving the high velocity is to pass the water under pressure through restrictor jets positioned on the cutting cone close to the cutter picks, one jet to each pick. It follows therefore that to keep the volume of water used within reasonable limits the number of jets must be kept low and therefore the cutting cone size is restricted since the number of cutter picks is similarly reduced.

On boom type machines utilising cutting drums or cutting cones referred to hereinafter as 'cutting heads', the cutter picks mounted thereon are presented to the face being cut for only half of one revolution, i.e. 180° of the surface of the drum or cone is in contact with the face at any one time, the other half being out of contact during this time.

Thus, it is now the practice on machines using water jets to provide water flow to or adjacent to the picks during the phase when these are presented to the mineral face and to cut off the flow for the remainder of the time. This has the effect of reducing the flow requirements at the face without detracting from the efficiency of the system, and mitigates or eliminates the problems already outlined and either permit lower volume handling means on the machine itself or an increase in cutter cone size by increasing the number of picks and corresponding jets.

One manner in which water can be phased is by providing retractable picks; thus when a pick engages the face to be cut it is forced to retract and this act releases the water jet.

Another method is to control the opening of valves which release water jets over a selected arcuate portion of the cutting head by using the same control means that controls the movement of the boom of a cutter boom assembly. In one known arrangement, up-down and right-left controls each operate a valve which provides a fixed water phasing arc of 180°. Thus for direct up or down movement, or for direct right or left movement only one 180° phasing arc emits water jets. However, for a compound movement, e.g. up and right, two 180° phasing arcs emit water jets, one for the 'up' control and one for the 'right' control. These arcs overlap to form a combined arc of 270°, of which only 180° is effective, thus producing 50% unnecessary water.

It is an object of this invention to provide a water phasing arc of no more than 180° and which is positionally variable around the cutting head.

According to the present invention there is provided a mining machine having a boom assembly including a rotary cutting head which carries picks, means to supply water jets directed onto or adjacent to the picks of said cutting head and means to phase the supply of water to selected picks only, namely to those picks on an arcuate surface of the rotary cutting head which engages the face to be cut out, said arcuate surface forming a water phasing arc which is no greater than 180° and being infinitely position adjustable around the cutting head such that the selected direction of movement of the boom assembly always bisects the said water phasing arc.

Preferably a drive swash plate and brake swash plate are mounted on a common longitudinal rotatable tubular shaft in relatively fixed disposition, such that when the brake swash plate is braked, the drive swash plate is correctly positioned to open valves of water chambers in the cutting head to provide water jets over the selected water phasing arc.

Preferably also, the means to supply water jets to or adjacent to the picks includes a plurality of circumferentially disposed chambers in the rotary cutting head each to direct at least one jet onto or adjacent to one or more picks and each having valve means to control entry of water thereinto, and said means to phase the water supply comprises a drive swash plate which is in surface contact with the valve means of the chambers and is adapted in use to be stationary relative to the rotating head for actuating the valve means of those chambers moving into the face cutting area to allow entry of water to those chambers.

Prefer also, water is fed to the chambers of the cutting head by an axial rotatable tube or 'lance' on which the drive swash plate is fixedly mounted, and a brake swash plate is also mounted on said axial tube for engagement with brake means adapted to stop rotation of the tube such that the swash plate is in a stationary disposition to actuate the appropriate valve means relative to the location of the cutting face of the cutting head.

Preferably, during non-cutting of the rotating cutting head, the brake means is disengaged and the rotating valve means engaging the drive swash plate maintain their last cutting disposition whereby to cause rotation of said plate, lance and brake swash plate.

Preferably also the drive swash plate and brake swash plate are synchronised such that braking of the brake swash plate positions the drive swash plate in the correct stationary phasing attitude relative to the valve means of those chambers moving into the selected face cutting area of the cutting head.

An embodiment of the present invention will now be described, by way of example, with reference to the accompanying drawings, in which.

Figure 1:
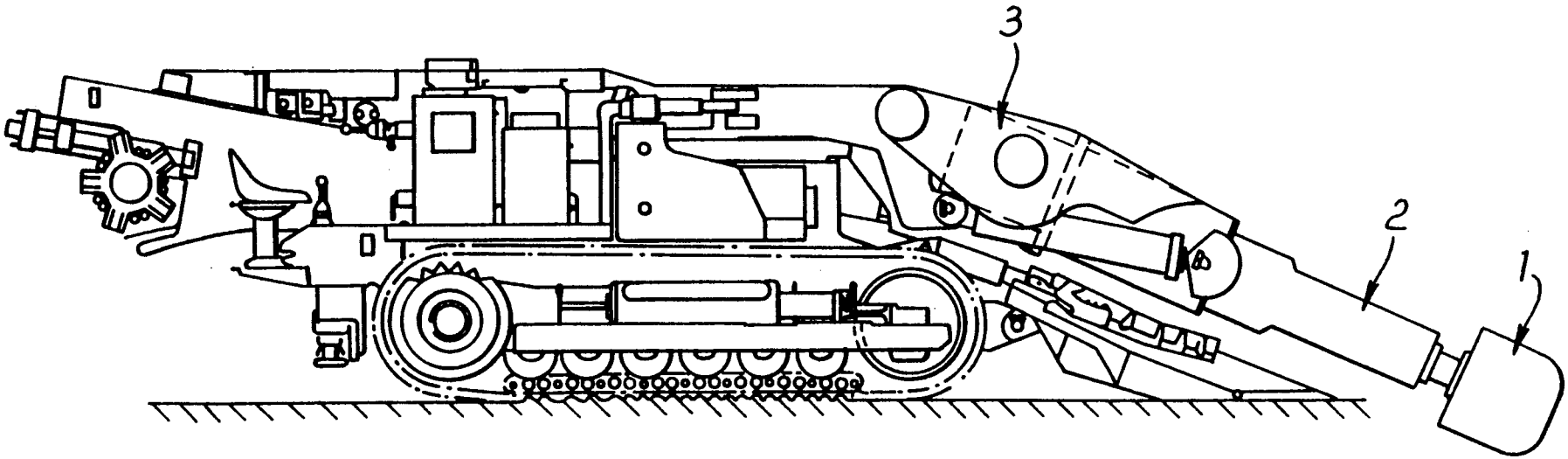
FIG. 1 is a side elevation of a mining machine having a rotary cutting head mounted on a cutting boom.
Figure 2:
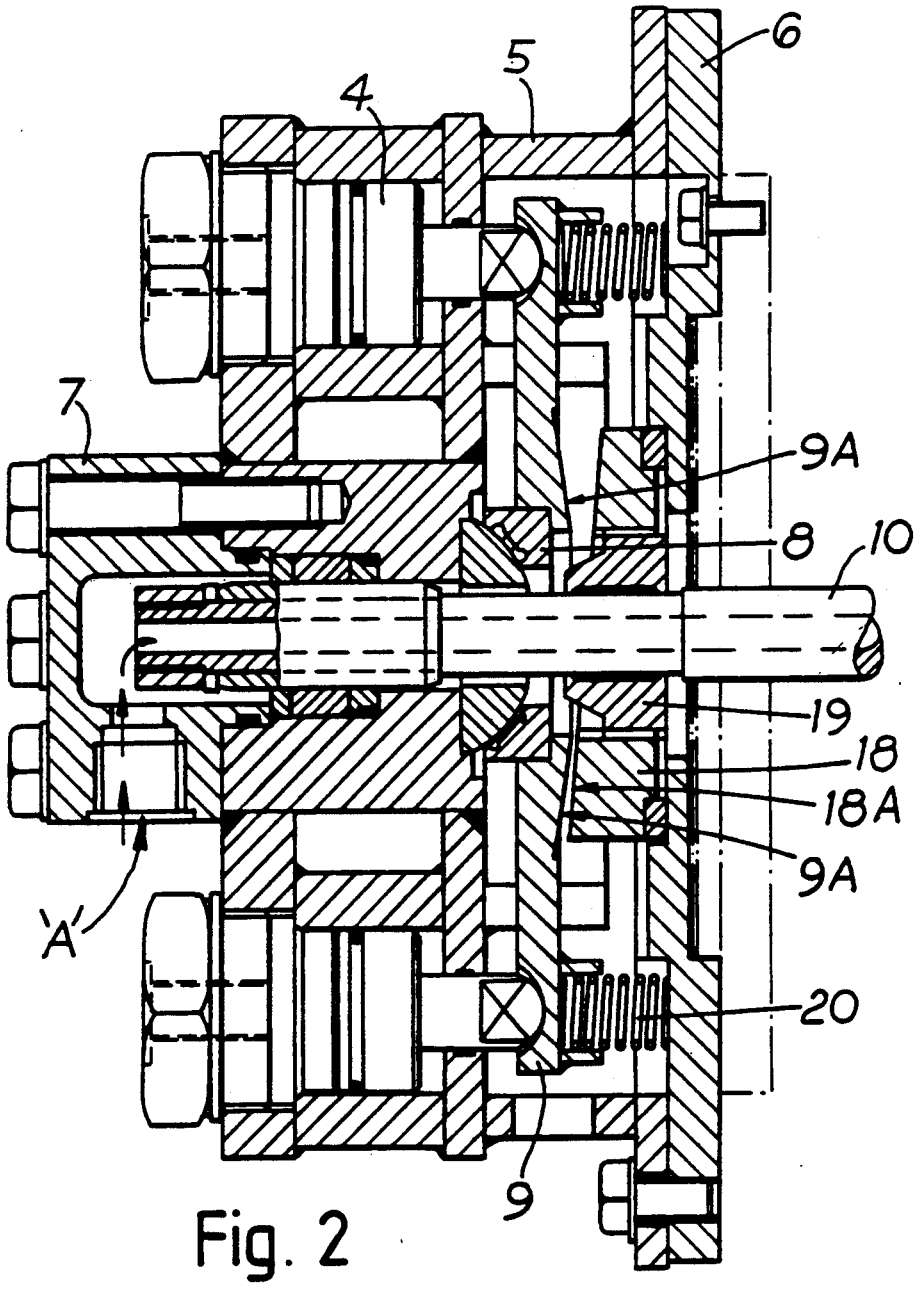
FIGS. 2 and 3 are sectional elevations of the rear end of the cutter boom and the cutting head respectively of a mining machine according to the invention.

In a preferred embodiment the water phasing arrangement is applied to the cutting boom of a roadheading machine, FIG. 1 wherein the cutting head 1 is of conical form and is co-axial with a boom assembly 2. The principal areas of the phasing arrangement are within the cutting head 1 and at the rear of the cutter boom electric motor 3, the areas being connected by a water conduit or lance 10 as shown in FIGS. 2 and 3.

The phasing of the water system is controlled hydraulically by the same joystick control circuit which activates the attitude and position of cutting boom 2. Manual operation of the joystick valve (not shown) supplies hydraulic pressure selectively to four pistons 4 shown in FIG. 2. These four pistons are situated at the rear of a brake carrier 5 which is mounted, via an adaptor plate 6 on the non-drive end of the electric boom motor 3, FIG. 1.

The brake carrier 5 incorporates an integral rotary seal assembly which has an end cap 7 and a spherical bearing arrangement 8 which carries a brake plate 9. Water is delivered to the cutting head 1. FIGS. 1 and 2, via port 'A' on end cap 7 and the rotatable lance 10, FIGS. 2 and 3, and is indicated by arrows passing through the apparatus.

Figure 3:
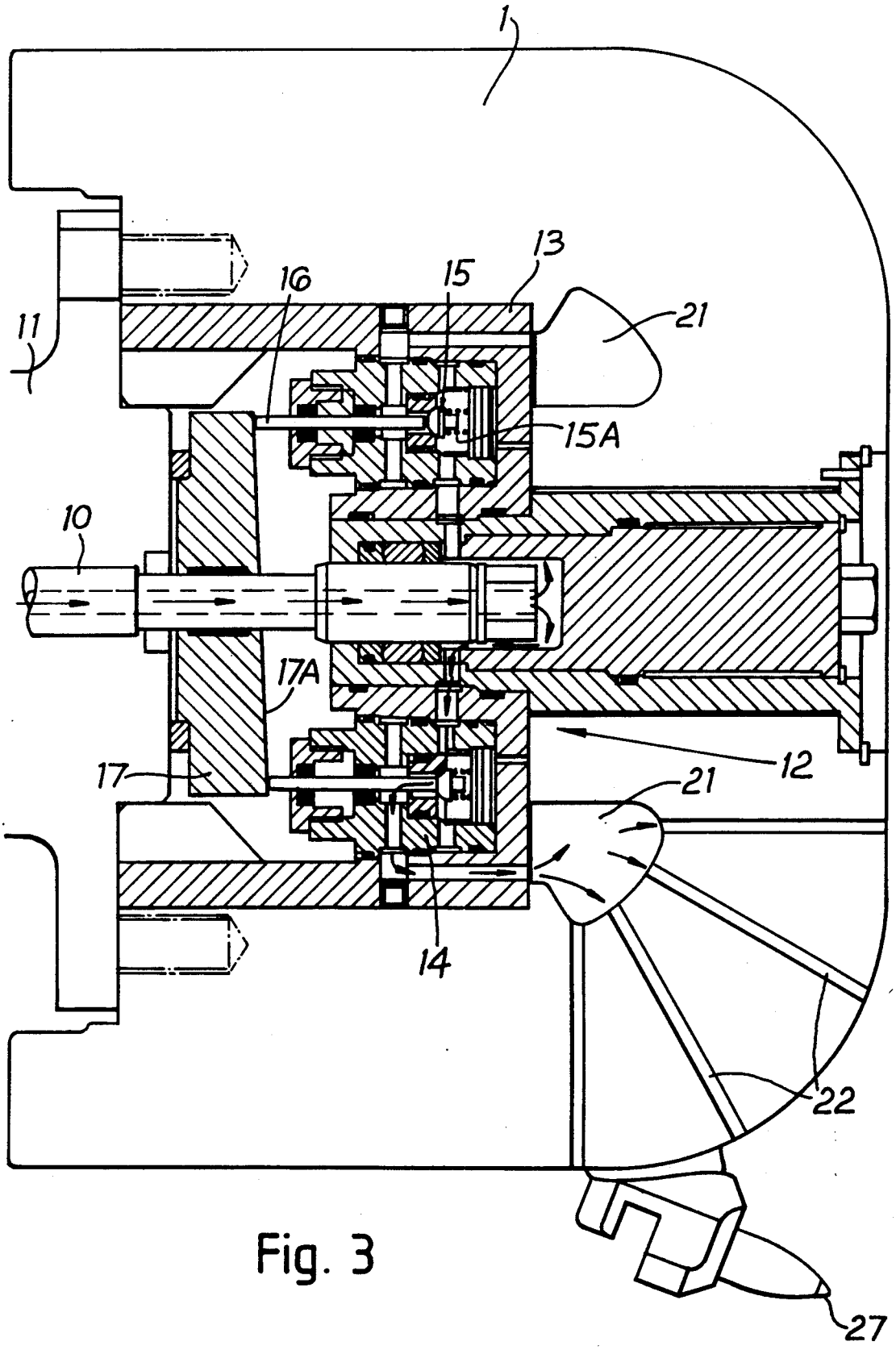

The cutting head 1 is driven mechanically through a cutter shaft 11, FIG. 3, and incorporates a water phasing drive unit 12 which is in turn driven by the cutter head 1 through a key (not shown).

The water phasing drive unit 12 consists of an outer case 13 which houses six individual water valve chamber assemblies 14. Each valve chamber assembly incorporates a valve 15 which has a spring 15A and a drive piston 16.

A drive swash plate 17 is fitted to the lance 10 at the cutter head and is driven by the six pistons 16 which abut a forwardly facing sloping face 17A of the drive swash plate.

A similar swash plate 18, FIG. 2 is fitted to the lance 10 at the motor end within the brake carrier 5. This swash plate 18 acts as a brake swash plate and is fitted via an involute gear 19 which allows synchronising of the water phasing by varying the relationship between swash plates 17 and 18. The brake swash plate 18 has a rearwardly facing sloping face 18A which lies adjacent to the central area of the brake plate 9. That central area has a forwardly facing frusto conical surface 9A, a portion of which can engage against the sloping face 18A of the brake swash plate 18.

The arrangement operates as follows:

When the hydraulic joystick (not shown) is in the neutral position the fluid within the four pistons at the rear of the brake carrier 5 is not pressurised and the pistons 4 are in a retracted position under the influence of four springs 20 acting on the brake plate 9. The brake plate 9 is therefore not engaged with the brake swash plate 18 and the lance is free to rotate.

The rotation of the lance 10 is induced by the rotary action of the series of drive pistons 16 against the drive swash plate 17. The drive pistons 16 exert varying individual loads on the drive swash plate 17 and these loads depend on the position of each drive piston on the surface of the drive swash plate and the loads exerted on them by the valves 15. The loads are induced by the pressure of water supplied to the cutting head 1 via the lance 10.

Pressurised water flows through particular valves which are held open at this stage due to the positioning of their respective drive pistons 16 on the drive swash plate 7. As the cutting head rotates, carrying the pistons in a circular path, the varying individual loads pressing against the drive swash plate 17 cause the plate to rotate and consequently so also does the lance 10 and the brake swash plate 18. However, since the drive swash plate 17 and cutting head 1 are rotating together the movement of individual drive pistons 16 is prevented and this results in there being no valve action and therefore no water phasing action at this stage; water jets simply continue to emit from those valves which have remained open rotating with the rotating cutting head.

When the hydraulic joystick (not shown) is in any operating position fluid energises the appropriate selection of pistons 4, FIG. 2 causing brake plate 9 to tilt against brake swash plate 18 halting the free rotation of the lance 10. This in turn positions the drive swash plate 17, FIG. 3 in the correct phasing attitude.

With the drive swash plate 17 stationary and the cutting head 1 still rotating, each of the drive pistons 16 raises and lowers in turn against the surface of plate 17 to progressively open and close particular valves 15 in the correct phasing sequence, i.e. to provide a water phasing arc 25 of a 180° maximum over that portion of the cutting head which is moved towards and into contact with a surface to be cut, the direction of movement being illustrated by around 26. Pressurised water flows through these valves 15 into chambers 21 on the cutting head 1 and thence via conduits 22 to jets directed at the cutter picks 27 to provide jet assisted cutting.

Figure 4:
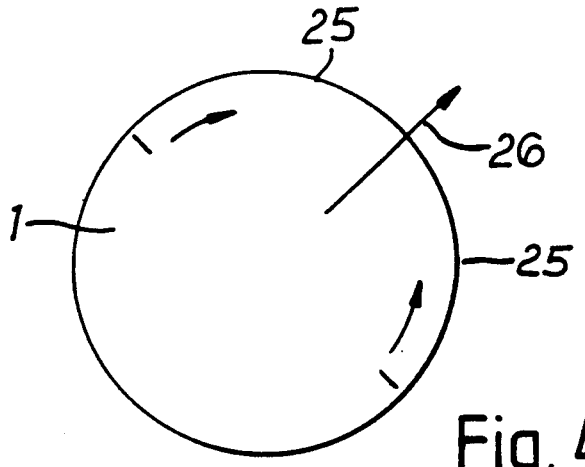
FIG. 4 is a detail.

The water phasing arc 25 is infinitely position adjustable around the cutting head 1 such that any selected direction of travel 26 of the cutting boom bisects the water phasing arc 25 as illustrated in FIG. 4, which is a diagrammatic front view of the cutting head 1. Due to the synchronised disposition of the swash plates 17, 18, and the fact that pistons 4 which actuate the brake plate 9 are controlled in parallel with jacks that move of the cutting boom 2, the drive swash plate 17 will always adjust the position of the water phasing arc 25 so that it is bisected by the selected direction of movement 26 of the boom assembly.

Further, as the valves 15 progressively open and close as they move into and out of the water phasing arc 25, the amount of water delivered to the picks varies as each individual valve progressively opens and then closes.

The water pressure for jet assisted cutting is normally in the region of 5 to 10 thousand psi.

It is considered, however, that a lower water pressure may be sufficient to cause rotation of the drive swash plate 27 while the hydraulic joystick is in neutral and phased jets from such a water pressure would provide useful dust suppression at the cutting surface of the cutting head.

As a result of water phasing over only 180° and adjustably positioning the water phasing arc, the amount of water used may be reduced or the cutting head increased in size to provide additional picks.

I claim:

1. A mining machine having a boom assembly, said boom assembly being selectively movable in a plurality of directions and including:

a rotary cutting head having an arcuate surface, said arcuate surface forming a water phasing arc which is no greater than 180° and is infinitely position-adjustable around said cutting head such that the selected direction of movement of said boom assembly always bisects said water phasing arc;

a plurality of picks carried by said cutting head;

water jet means for supplying water jets directed onto or adjacent said picks;

valve means for opening and closing said water jet means;

a longitudinal rotatable tubular shaft;

a selectively rotatable drive swash plate mounted on said tubular shaft, said drive swash plate rotatably driving said shaft and said drive swash plate when stationary selectively actuating said valve means to phase the supply of water to those of said picks which engage the face to be cut out;

a brake swash plate mounted on said tubular shaft in relatively fixed disposition with respect to said drive swash plate, said brake swash plate being rotatable with said tubular shaft; and brake means braking said brake swash plate, whereby when said brake wash plate is braked, the rotation of said tubular shaft is halted and said drive swash plate is correctly positioned to open said valve means to provide water jets over the selected water phasing arc.

2. The mining machine of claim 1, wherein said water jet means includes a plurality of chambers circumferentially disposed in said cutting head, each of said chambers directing at least one jet onto or adjacent to one or more of said picks, each of said chambers having one of said valve means for controlling entry of water thereunto; and wherein said drive swash plate is in surface contact with said valve means and is stationary relative to said cutting head for actuating said valve means of those of said chambers moving into the face cutting area to allow entry of water to those said chambers.

3. The mining machine of claim 2, wherein water is fed to said chambers by said tubular shaft; and wherein said brake means engages said break swash plate to stop rotation of said tubular shaft.

4. The mining machine of claim 3, wherein said brake means is disengaged when said cutting head is not cutting; and wherein said valve means in contact with said drive swash plate maintain their last cutting disposition to cause rotation of said drive swash plate, said tubular shaft, and said brake swash plate when said cutting head is not cutting.

5. The mining machine of claim 3, wherein said drive swash plate and said brake swash plate are synchronized and braking of said brake swash plate positions said drive swash plate in the correct stationary phasing attitude relative to said valve means of those of said chambers moving into the selected water phasing arc.

6. The mining machine of claim 3, wherein said brake means comprises:

a brake plate positionable in a first position in which it is disengaged from said brake swash plate and a second position in which it is tilted such that a selected portion of said brake plate is engaged with said brake swash plate, said brake plate allowing free rotation of said brake swash plate when in said first position and halting free rotation of said brake swash plate when in said second position; and a plurality of pistons selectively actuable to position said brake plate in one of said first and second positions.

7. The mining machine of claim 6, further comprising:

hydraulic means for moving said boom assembly in any selected direction and control means for selectively actuating said plurality of pistons and said hydraulic means.

8. The mining machine of claim 1, wherein said boom assembly has a drive end and a non-drive end, and wherein said mining machine further comprises a brake carrier assembly mounted at said non-drive end of said cutter boom.

9. The mining machine of claim 1, further comprising a plurality of pistons, wherein each of said valve means has a corresponding piston abutting said drive swash plate for progressively actuating said valve means as it rotates around said drive swash plate.

* * * * *